US005803591A

United States Patent [19]

Lin

[11] Patent Number: 5,803,591

[45] Date of Patent: Sep. 8, 1998

[54] FASTENING MECHANISM USED IN MINIATURE LIGHT BULB SERIES

[76] Inventor: Francis Lin, No. 196, Chin Long Road, Hsiao Chin Ko Cheng, Whair Chou City, Konton, China

[21] Appl. No.: 792,855

[22] Filed: Jan. 23, 1997

[51] Int. Cl.[6] ..... H01R 33/00

[52] U.S. Cl. ..... 362/226; 362/249; 439/356

[58] Field of Search ..... 362/226, 249, 362/252, 382, 391, 238, 806; 439/616, 619, 356

[56] References Cited

U.S. PATENT DOCUMENTS

| | | | |
|---|---|---|---|
| 4,943,899 | 7/1990 | Tseng | 362/226 |
| 4,970,632 | 11/1990 | Tseng | 362/226 |
| 5,428,516 | 6/1995 | Harris | 362/249 |
| 5,647,759 | 7/1997 | Lien | 439/356 |
| 5,701,051 | 12/1997 | Lin | 362/249 |

*Primary Examiner*—Thomas M. Sember
*Attorney, Agent, or Firm*—Rosenberg, Klein & Bilker

[57] ABSTRACT

The invention relates to an improved fastening mechanism used in a decorative light bulb series. The improvement according to the invention includes a light bulb socket with two opposite lugs formed on the peripheral rim of the top end thereof and a housing provided on the side surface thereof with a locating post having tapered cross sections. When the light bulb socket is placed into the housing, the locating post extends into the passageway defined by two lugs to form a firm engagement between the socket and the housing. To detach the light bulb socket from the housing, just apply a force large enough on the bottom surface of the locating post. The socket can easily get out of the constraints exerted by the lugs without any damages to either the socket itself or the housing. Hence the assemblage and detachment can be repeatedly conducted.

2 Claims, 6 Drawing Sheets

FASTENING MECHANISM USED IN MINIATURE LIGHT BULB SERIES

BACKGROUND OF THE INVENTION

The structure used in an average miniature light bulb series usually employs fastening means to enhance the combination of the light bulb socket with the housing in order to protect the socket against disengagement from the housing or a poor contact between them. As an illustrative example, FIGS. 1 and 2 show a prior art socket and housing. The housing (2) includes two parallel protrusions (21) formed on the peripheral rim of the top thereof. The socket (1) is provided on the side surface with an engagement block (11). The engagement block (11) has a hook portion (12) on its lower end. When the light bulb socket (1) is installed on the housing (1), the engagement block (11) extends into the space between the parallel protrusions (21), with the hook portion (12) holding on the bottom faces of two protrusions to form a combination. However, such means are difficult to separate after parts being assembled. If the joining is forcefully disengaged, the engagement block (11) and the hook portion (12) will damage and lose their functions, as a consequence of which the light bulb socket (1) and the housing (2) can not be used any more.

OBJECTS OF THE INVENTION

In view of the above problems, the object of the invention is to provide an improved fastening mechanism that can detachably combine a light bulb socket with a housing with ease. Now the features and advantages of the invention will be detailed in the following description with reference to the accompanying drawings.

BRIEF DESCRIPTION OF THE INVENTION

Figure 1:
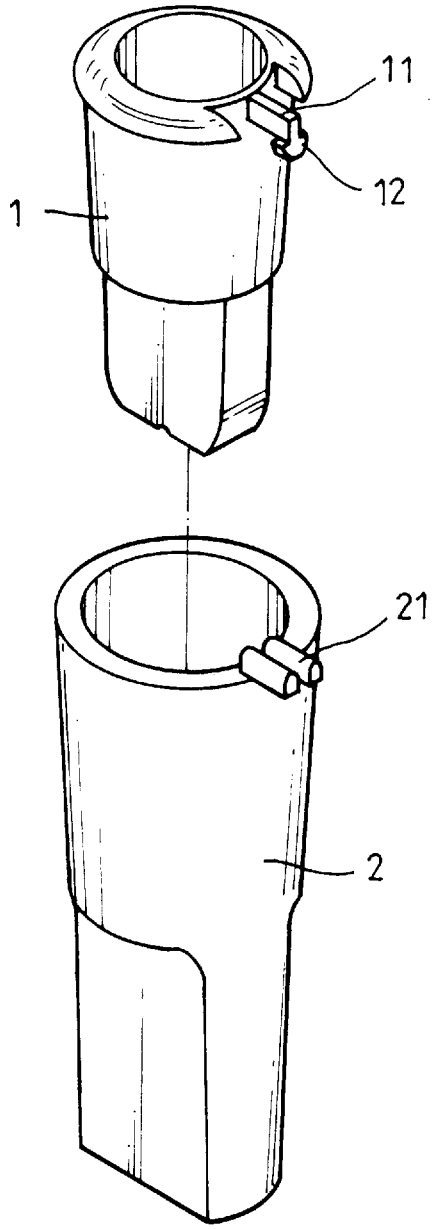
FIG. 1 (prior art)
FIG. 1 is an exploded view showing the configurations of a prior art light bulb socket and a housing.
Figure 2:
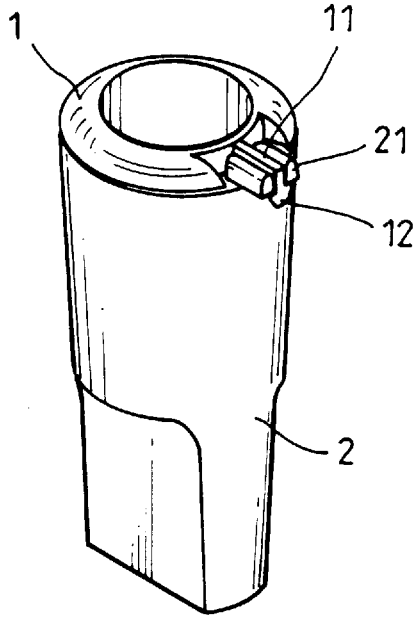
FIG. 2 (prior art)
FIG. 2 shows the combination of the prior art socket with a housing.
Figure 3:
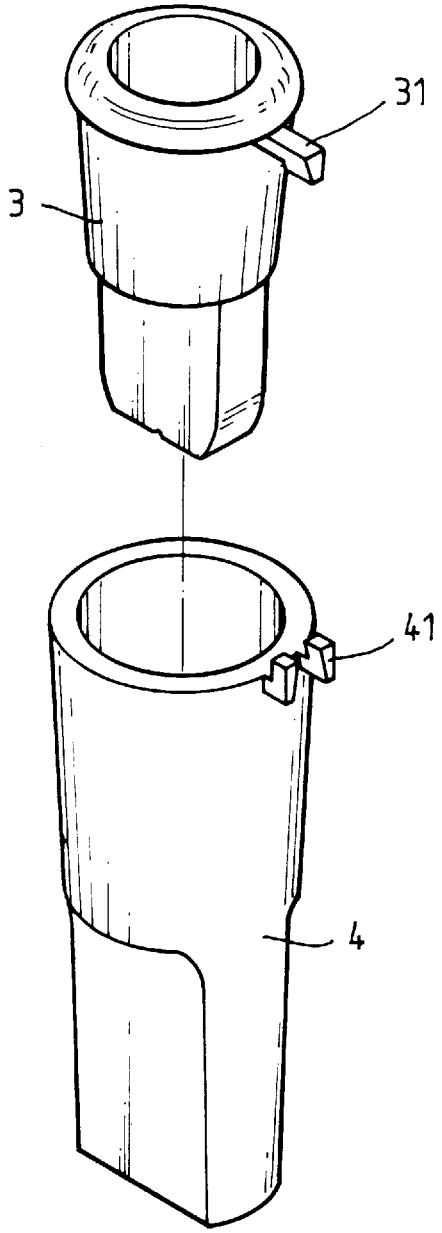

FIG. 3 perspectively explosively shows a light bulb socket and a housing, which employ a fastening mechanism according to the invention.

Figure 4:
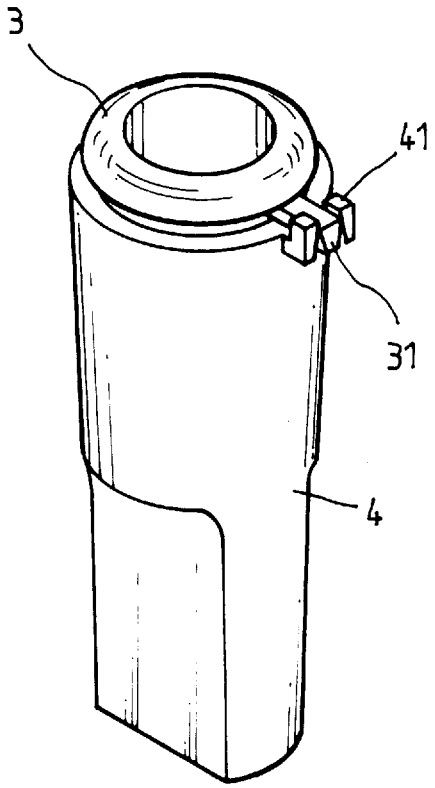

FIG. 4 shows the socket and the housing of FIG. 3 in an assembled state.

Figure 5:
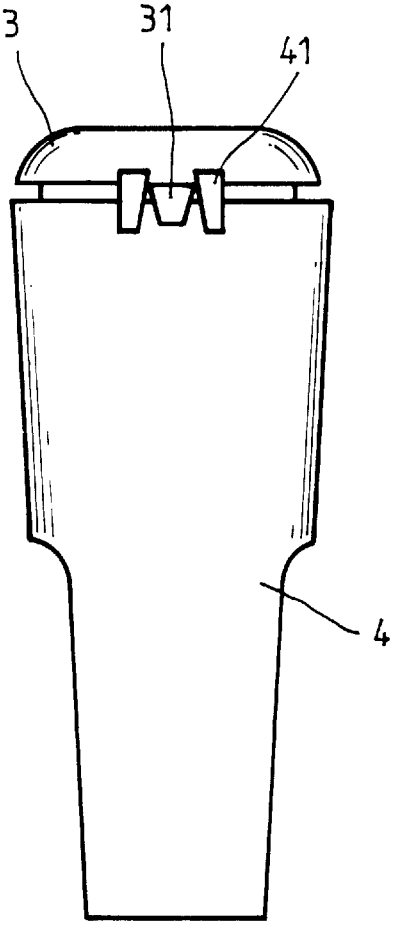

FIG. 5 is a plan view depicting the fastening mechanism according to the invention.

Figure 6:
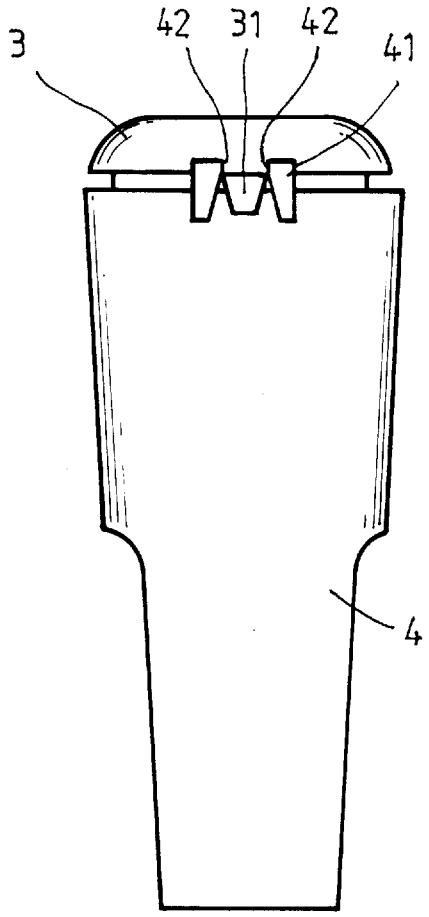

FIG. 6 shows a variant of the fastening mechanism of the invention.

DETAILED DESCRIPTION OF THE INVENTION

Referring to FIGS. 3 through 5, the invention includes a light bulb socket (3) and a housing (4) that both have conventional configurations but are featured by two symmetrical flexible lugs (41) formed on the peripheral rim of the upper end of the socket (3) and a locating post (31) extending from the side surface of the housing (4). The two lugs (41) each has an inclined internal surface opposite to each other, cooperatively defining a tapered passageway that has a narrower upper opening and a wider lower opening. The locating post (31) has a tapered cross section with narrower top surface and wider bottom surface and the width of the top surface is slightly wider than that of the upper opening of the passageway between these two lugs (41).

When the socket (3) is placed into the interior of a housing (4), the locating post (31) extends into the passageway between two flexible lugs (41) and slightly outwardly biases them so that the opposite surfaces of two lugs (41) press against the opposed edges of the top surfaces of the locating post (31) to form an effective engagement.

To separate the socket (3) from a housing (4), just apply an upward force on the bottom surface of the locating bar (31). The socket (3) can easily get out of the constraints exerted by the lugs (41) due to the flexibility of the lugs, without any damages to either the socket itself or the housing. Hence the invention can overcome the deficiency of a conventional structure and enhance the performance.

As can be seen from FIG. 6, which shows a variant of the invention, the lugs respectively have a vertical surface (42) disposed on the upper portion of the opposite internal surfaces. The passageway between those two vertical surfaces (42) is narrower than the width of the top surface of the locating post (31). Such a design can make the engagement of the socket with the housing more smooth. Therefore, the fastening mechanism according to the invention has originality and effectiveness.

What is claimed is:

1. An improved fastening mechanism used in a decorative light series, comprising a light bulb socket and a housing, and characterized in that said housing is provided with two opposite flexible lugs and said light bulb socket has a locating post horizontally extending from a side surface thereof, said two lugs each having an opposed inclined internal surface to form therebetween a passageway with a narrower upper opening and a wider lower opening;

said locating post being configured to have a wider top surface and a narrower bottom surface and the top surface of said locating post being slightly wider than the upper opening of said passageway defined by said two lugs so that when said light bulb socket is placed into said housing said locating post will extend into said passageway so that the two lugs forcefully press against the locating post to constitute a firm engagement.

2. An improved fastening mechanism as claimed in claim 1, wherein the opposed internal surfaces of said two lugs are configured to respectively have a vertical portion and a distance between the vertical portions is smaller than the width of the top surface of said locating post.

* * * * *